US007748332B2

(12) United States Patent
Lonati

(10) Patent No.: US 7,748,332 B2
(45) Date of Patent: Jul. 6, 2010

(54) AUTOMATIC DEVICE AND METHOD FOR ORIENTING TEXTILE ITEMS ON BLOCKS

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 634 days.

(21) Appl. No.: 11/744,419

(22) Filed: May 4, 2007

(65) Prior Publication Data

US 2007/0278258 A1 Dec. 6, 2007

(30) Foreign Application Priority Data

May 18, 2006 (EP) ..... 06425335

(51) Int. Cl.
*D05B 39/00* (2006.01)
*D05B 35/00* (2006.01)

(52) U.S. Cl. ..... 112/475.12; 112/470.15

(58) Field of Classification Search ..... 223/75, 223/77, 111, 112; 112/470.09, 470.14, 470.18, 112/322, 475.02–475.05, 475.07, 475.08, 112/475.12, 470.15
See application file for complete search history.

(56) References Cited

U.S. PATENT DOCUMENTS 4,308,980 A 1/1982 Gazzarrini et al.
4,611,733 A 9/1986 Nishikawa et al.
5,904,279 A 5/1999 Bertram et al.
5,941,431 A * 8/1999 Parker ..... 223/112
6,913,173 B2 * 7/2005 Manini ..... 223/75
7,044,071 B2 * 5/2006 Jordan et al. ..... 112/470.08
2004/0108343 A1 6/2004 Bagni

FOREIGN PATENT DOCUMENTS

EP 0 033 039 B1 11/1984
EP 1 348 795 A2 10/2003

* cited by examiner

*Primary Examiner*—Ismael Izaguirre
(74) *Attorney, Agent, or Firm*—Pearne & Gordon LLP

(57) ABSTRACT

An automatic device (1) for orienting tubular textile items (3) on blocks (2), comprising a block (2) for receiving the textile item (3) having a reference (4) with respect to which the item (3) is to be oriented for reaching a pre-established operating position with respect to the block (2), orientation means (9) for shifting the item (3) on the block (2) for bringing it in the pre-established operating position, a detection element (13) for determining the initial position of the reference (4) when the textile item (3) is loaded onto the block (2), with respect to the pre-established operating position, and processing means connected to the detection element (13) and acting upon the orientation means (9) for orienting the textile item (3) and bringing it in the pre-established operating position.

32 Claims, 3 Drawing Sheets

AUTOMATIC DEVICE AND METHOD FOR ORIENTING TEXTILE ITEMS ON BLOCKS

FIELD OF THE INVENTION

The present invention relates to an automatic device and to a method for orienting textile items on blocks.

The invention relates in particular to a device and to method for orienting textile items on ironing blocks associated with machines for ironing textile items, though without losing its general character.

BACKGROUND OF THE INVENTION

The expression "textile items" refers preferably to tubular textile items closed at one end, such as stockings or socks, though without limiting the general idea protected by the invention.

As is known, tubular textile items are loaded onto ironing blocks manually by an operator. The textile items should be placed on the block according to a pre-established orientation so that ironing is uniform and ensures a good appearance both when packaging the item and when the latter is put on. In particular, the item should be oriented with respect to a reference, which—in the case of stockings and socks for instance—is preferably represented by the toe-closing seam or, if necessary, by a notch made on a portion of said item. As a consequence, after slipping the textile item onto the block, the operator orients the latter if its initial orientation differs from the pre-established optimal orientation.

In the process for manufacturing stockings and the like, ironing machines are usually placed after knitted-seaming machines, which seam the stocking toe.

In order to increase the effectiveness of the whole process for manufacturing textile items and to eliminate the dependence on human intervention, automatic loading systems for ironing machines have been introduced. As is known, such systems consist of a pick-and-place station and of a loader. In particular, in the pick-and-place station the textile item is picked up and conveyed, for instance by means of air jets, into a pipe frame inside which a first orientation can take place. The stocking is then picked up by a loader which slips it onto a block on which a particular positioning is carried out, so as to reach the pre-established optimal orientation of the item according to the reference.

Known devices are provided with handling means associated with the block, which rotate the textile item on the block until a sensor detects the optimal position of the reference.

However, these devices tend to be slow and, more to the point, they do not enable the orientation of a second reference, if present, on the textile item, which can be for instance a pattern or a second notch.

Under these circumstances the technical task underlying the present invention is to propose an automatic device for orienting textile items on blocks and a corresponding method, which are an alternative to existing devices and methods and do not show the drawbacks affecting the latter.

A further aim of the present invention is to propose an automatic device and a method for orienting textile items on blocks, which enable a rapid and simple orientation of a textile item that has then to undergo further operations, preferably finishing operations. Another aim of the invention is to provide an automatic device and a method for orienting textile items on blocks, which enable the orientation of a textile item with respect to more than one reference, for instance in case of a stocking with respect to the toe seam and to a pattern on the lateral portion to be associated with the leg of said stocking.

An additional aim of the invention is to show an automatic device and a method for orienting textile items on blocks, which can be integrated effectively into the whole process for manufacturing textile items, referring in particular to the ironing step, so as to reduce times and costs.

A final aim of the invention is to propose an automatic device and a method for orienting textile items on blocks, which can be easily carried out and whose costs are low.

These and other aims that will emerge from the following description are achieved according to the present invention by an automatic device and a method for orienting textile items on blocks in accordance with the appended claims.

BRIEF DESCRIPTION OF THE DRAWINGS

Further characteristics and advantages of the invention will appear from the description of a preferred though not exclusive embodiment of the device, shown to a merely indicative purpose in the accompanying drawings, in which.

DESCRIPTION OF THE PREFERRED EMBODIMENTS OF THE INVENTION

Figure 1:
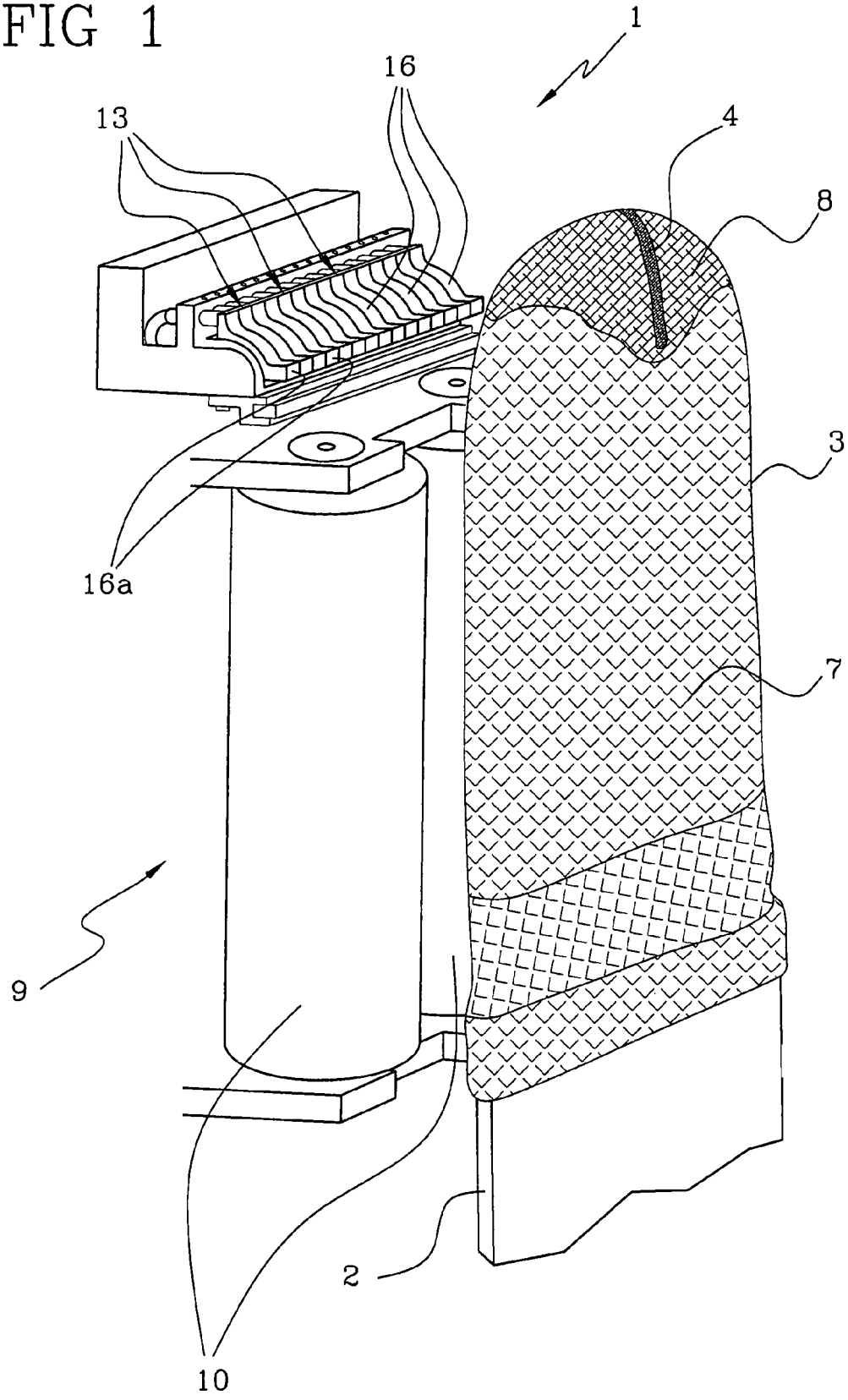
FIG. 1 shows a schematic perspective view of automatic device for orienting textile items on blocks in accordance with the invention.

Referring to the figures above, an automatic device for orienting textile items on blocks according to the invention is referred to as a whole in the accompanying drawings with number 1 and comprises at least one block 2 designed to receive a textile item 3 having at least one reference 4 with respect to which the item 3 should be oriented in order to reach a pre-established operating position with respect to the block 2, and orientation means 9 designed to shift the textile item 3 on the block so that it reaches said pre-established operating position. In accordance with the invention, the device 1 further comprises at least one detection element 13 designed to determine the initial position of the reference 4 when the textile item 3 is loaded onto the block 2, with respect to the pre-established operating position, and processing means operatively connected to the detection element 13 and acting upon the orientation means 9 for orienting the textile item 13 so that it reaches the pre-established operating position.

Preferably, in the present description and in the accompanying figures a textile item 3 is a sock or a men's, women's or children's stocking.

Generally, the reference 4 comprises a portion having a higher textile density than the average density of the textile item 3 and preferably protruding with respect to the textile item. When the item 3 is a stocking or a sock, said reference 4 is advantageously the toe seam. As a matter of fact, stockings and socks are manufactured starting from an open textile tubular item, which is then closed at one end by means of so-called knitted-seaming machines, so as to match this end with the foot toe.

As an alternative, the reference 4 can also be a notch made on the lateral surface 7 of the item, though preferably on an upper portion 8.

Moreover, in a preferred embodiment of the device, the blocks 2 on which the item 3 is loaded and then oriented are ironing blocks 2 having in general a basically flat structure so as to prepare the item 3 for the packaging during the finishing steps.

In the preferred embodiment, the device 1 comprises a plurality of detection elements 13 designed to get in contact with at least one portion of the textile item 3 on the reference 4, so that at least one of these detection elements 13 detects the initial position of said reference 4.

The detection elements 13 send signals to the processing means, which preferably comprise an electronic card and are designed to determine the extent of the clockwise or counter-clockwise rotation of the textile item 3 by means of the orientation means 9 so that it reaches the pre-established operating position, depending on which detection element 13 detects the reference 4 when it is in the initial position. As a matter of fact, in order to locate the item 3 in the pre-established operating position, the orientation means 9 preferably rotate it with respect to the block 2.

Figure 2:
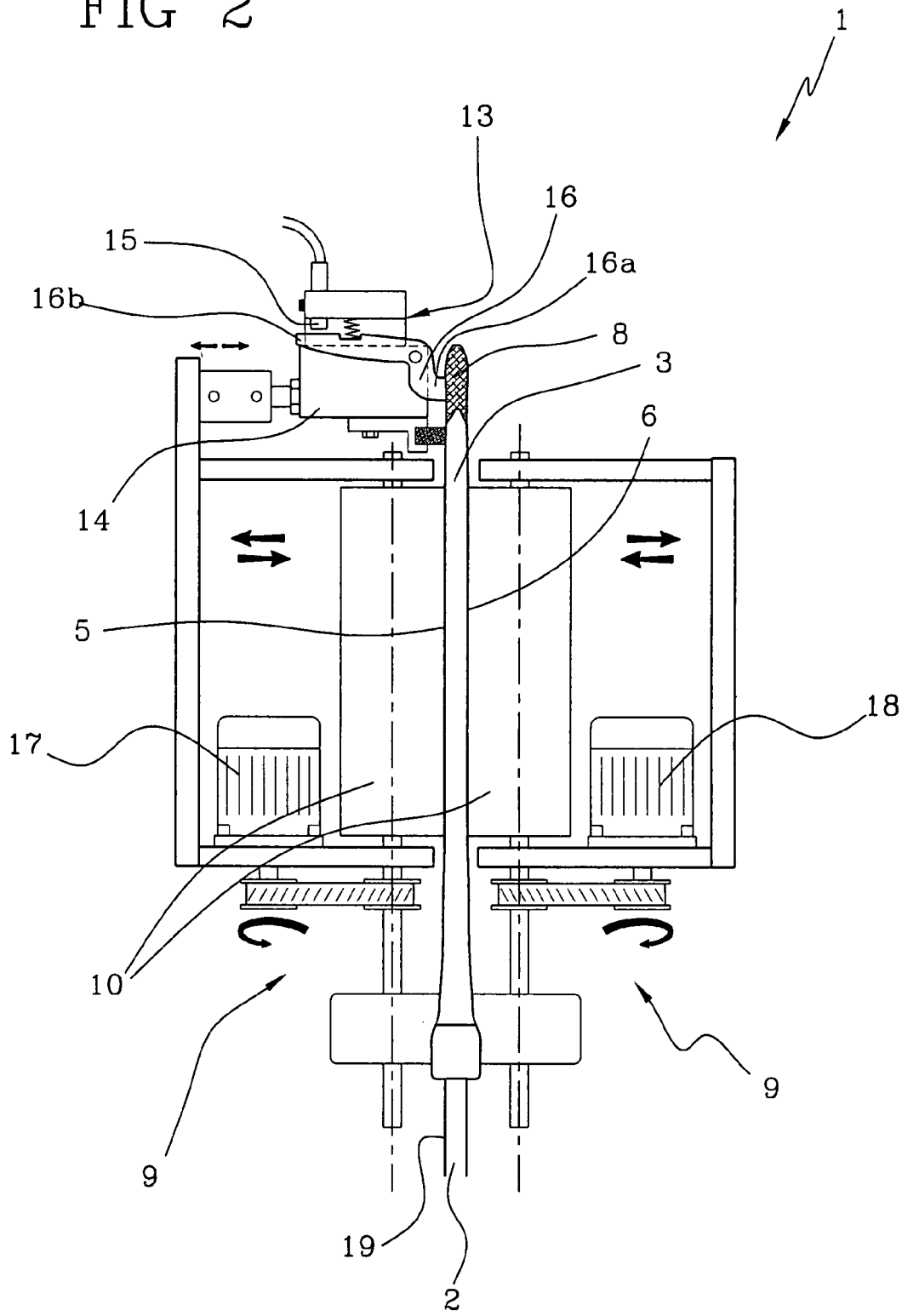
FIG. 2 shows a schematic lateral view of the device of FIG. 1.
Figure 3:
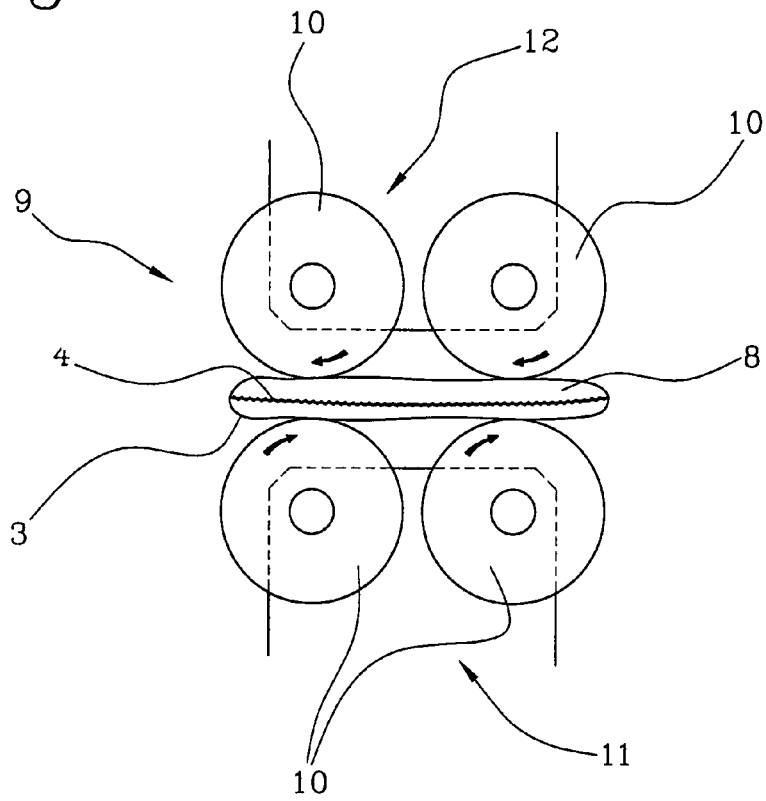
FIG. 3 shows a schematic top view of the device of FIG. 1.
Figure 4:
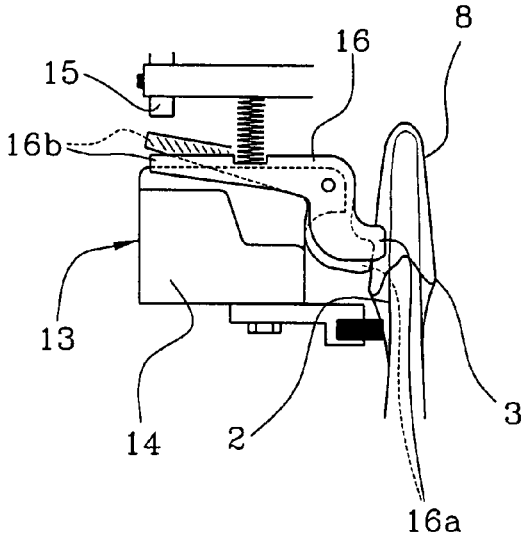
FIG. 4 shows a schematic detailed view of a detection element of the device of FIG. 1.

Advantageously, the detection elements 13 generally comprise a position sensor of any type. Preferably, as can be seen in FIGS. 2 and 4, each detection element 13 comprises a sensing unit 14 including in turn basically a proximity sensor 15 and at least one lever 16 designed to get in contact with the item 3 on a first end portion 16*a* and with the proximity sensor 15 on a second end portion 16*a*. In particular, every lever 16 can oscillate. Thus, when said lever 16 identifies the reference 4, its first end portion 16*a* is pushed downwards because of the protrusion of said reference 4, whereas the second end portion 16*a* is lifted accordingly and is detected by the proximity sensor 15 connected to the processing means.

Figure 5:
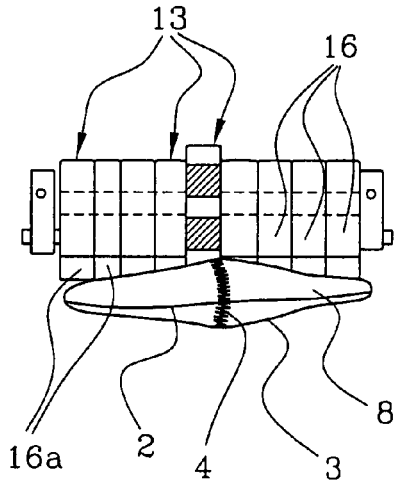
FIG. 5 shows a schematic top view of the detection element of FIG. 4.

Moreover, the detection elements 13 are associated one beside the other and are shifted integrally between an active position in which they get in contact with the item 3 so as to detect the initial position of the reference 4, and a passive position in which they are removed from the item 3 (FIG. 5).

In further detail, as was already mentioned above, in the preferred embodiment of the invention, the textile item 3 consists of a stocking or a sock, the reference 4 of the toe-closing seam and the blocks 2 are ironing blocks 2. Generally, the toe-closing seam extends basically along a semi-circumference of an upper portion 8 of the textile item 3. Since the ironing blocks 2 are flat, after the item 3 is loaded onto the block 2, at least one portion of the toe-closing seam lies on the front portion 19 of the block 2 upon which act the detection elements 13. As a consequence, the various detection elements 13 are associated with one another so as to cover the front portion 19 of the block 2 basically as a whole, thus ensuring the identification of the reference 4, i.e. of the seam, in its initial position, i.e. in the position in which it lies after the loading onto the block 2. As was already mentioned, the processing means, depending on the position of the detection element 13 detecting the presence of the reference 4 in the group of detection elements 13, determine the extent to which item 3 should be rotated on the block 2 and the direction of said rotation, so that the reference 4 reaches the pre-established operating position, and send the information to the orientation means 9, which physically shift the item 3 in the pre-established operating position.

Obviously, if by chance the item 3 is slipped onto the block 2 with the reference 4 already in the pre-established operating position (therefore, in this case the initial position of the reference 4 corresponds to the pre-established operating position), no orientation of the item 3 takes place.

Still in accordance with the invention, the orientation means 9 comprise at least one roller 10 arranged parallel to the block 2, though preferably at least one first pair 11 of rollers 10 arranged parallel to the block 2.

Advantageously, in the preferred embodiment of the device 1, the orientation means 9 further comprise a second pair 12 of rollers 10 arranged parallel to the block 2, so that the first pair 11 of rollers 10 can be associated to the front portion 5 of the textile item 3, whereas the second pair 12 of rollers 10 can be associated to the rear portion 6 of said item 3.

It should be pointed out that the rollers 10 of the various pairs 11, 12 can be equipped, if necessary, with extensions for increasing their area of contact with the textile item 3.

As for the detection elements 13, the pairs 11, 12 of rollers 10 can be shifted between an active position in which they are associated with the textile item 3, and a passive position in which they are removed and deactivated with respect to the textile item 3.

The orientation means 9 further comprise at least one first handling element 17, for instance comprising a motor, controlled by the processing means and designed to transmit motion to the first 11 and/or to the second pair 12 of rollers 10.

Preferably, each one of the two pairs 11, 12 of rollers 10 comprises a separate handling element 17, 18. As a matter of fact, textile items 3 can often have also a secondary reference, for instance in the case of a stocking or a sock a pattern made on the lateral surface 7 thereof, with respect to which the item 3 should be further oriented so as to shift also this secondary reference from an initial position to a pre-established operating position with respect to the pre-established operating position of the reference 4. As a consequence, the first 11 and the second pair 12 of rollers 10 firstly cooperate for the orientation of the reference 4, and secondly the second pair 12 of rollers 10 gets in contact with the item portion with which the secondary reference is associated and orients it.

Advantageously, the device 1 can comprise two blocks 2 and, as a consequence, the detection elements 13 and the orientation means 9, when in passive position, can shift transversally between a first operating position in which they act upon a first block 2, and a second operating position in which they act upon the other block 2. In this case, the transversal shift of the detection elements 13 and of the orientation means 9 corresponds to the axis between the two blocks 2. It should be further pointed out that the device 1 could also comprise more than two blocks 2 and that the detection elements 13 and the orientation means 9 would shift transversally between various operating positions so as to act selectively upon each of these blocks 2. A preferred embodiment of the device 1 according to the invention includes means for stretching the textile item 3. It should be pointed out that the textile item 3 can be stretched before the activation of the detection elements 13, so as increase the evidence of the reference 4, and during the activation of the orientation means 9, so as to eliminate folds and creases and prepare the item 3 for the following ironing step.

Preferably, the stretching function is performed by the orientation means 9. As a matter of fact, at least one between the first 11 and the second pair 12 of rollers 10 can shift vertically in its active position according to a direction basically parallel to the main axis of said rollers 10, along the lateral surface 7 of the textile item 3 so as to stretch the latter.

As an alternative, the device 1 can comprise dedicated stretching means, for instance mechanical grips or the like.

The inventive idea as shown before further comprises a machine for ironing textile items 3, characterized in that it comprises at least one automatic device 1 for orienting textile items 3 on blocks 2 in accordance with the above description.

As is known, ironing machines comprise a rotary table or turntable, onto which a plurality of blocks 2 is mounted, having a basically flat shape. Said table is handled between a series of consecutive stations, which generally comprise one or more loading stations, with which the above devices 1 are associated, and pulling stations, a steam-ironing chamber, a drying station, a control station and a device for taking off items 3 from blocks 2 and for positioning them for instance on a conveyor belt.

Finally, the invention includes a method for orienting textile items 3 on blocks 2 comprising the steps of loading a textile item 3, having a reference 4 with respect to which it should be oriented so as to reach a pre-established operating position, onto a block 2, and of detecting the initial position of the reference 4 of the textile item 3. The method is characterized in that it further comprises the steps of determining the necessary shift so as to bring the reference 4 from the initial position to the pre-established operating position, and of handling the textile item 3 with respect to the block 2 according to the shift that has previously been determined, so that it reaches the pre-established operating position.

Advantageously, the step of handling the textile item 3 with respect to the block 2 is performed by turning said textile item 3 on said block 2.

Moreover, the step of detecting the initial position of the reference 4 is performed by testing mechanically the presence of said reference 4 on the textile item 3, since the reference 4 preferably comprises a protruding portion, for instance the toe seam in case of a stocking or a sock.

Preferably, the described method further includes the step of stretching the textile item 3. Said step is performed at least before the step of detecting the initial position of the reference 4, so as to eliminate folds and creases and make said reference 4 more evident. The stretching step can also be performed during the step of handling the item 3 with respect to the block 2.

The method further includes a second step of detecting the initial position of the secondary reference, which is also associated with the item 3 and preferably with a lateral surface 7 thereof, after positioning the reference 4 in the pre-established operating position, and a second step of determining the necessary shift so as to bring said secondary reference in the pre-established operating position, and of handling the textile item 3 on the block 2 so that the secondary reference reaches the pre-established operating position. As was already mentioned, the step of detecting the initial position of the secondary reference, the second step of determining the shift and the second step of handling the textile item 3 on the block follow the step of handling the textile item 3 on the block 2 so that it reaches the pre-established operating position. Moreover, during said steps a stretching operation can be performed, so as to increase the visibility also of the secondary reference for the detection elements 13 and to eliminate folds and creases for the following step of ironing the item 3.

The invention thus conceived can undergo several changes and variants, all of which fall within the framework of the inventive idea.

Practically, any material or size can be used depending on the various needs.

Moreover, all details can be replaced by technically equivalent elements.

The invention has important advantages.

First of all, the automatic device and the method for orienting textile items on blocks allows to obtain a high-quality finished item, i.e. a stocking or a sock, thanks to the accurate orientation and to the stretching operation, which is preferably performed both before and during the orientation in the pre-established operating position of said item.

Thanks to the dependence of the handling operation on the two pairs of rollers, the device as described enables a correct positioning also of textile items having a complex structure in which not only a first reference but also a second reference, which is also located on a different item portion, should be oriented. Finally, the device and the method as described allow to load automatically the textile items onto ironing machines. As a consequence, the ironing step can be automated and integrated into accordingly automated manufacturing steps, such as the knitted-seaming step, which are performed on the item previously. It is thus possible to obtain advantages as far as manufacturing times, costs and product quality are concerned, eliminating the dependence on human intervention.

The invention claimed is:

1. An automatic device (1) for orienting textile items (3) on blocks (2), comprising:

at least one block (2) designed to receive a textile item (3) having at least one reference (4) with respect to which said textile item (3) should be oriented so as to reach a pre-established operating position with respect to said block (2), orientation means (9) designed to shift said textile item (3) on said block (2) so as to bring it in the pre-established operating position;

characterized in that it further comprises at least one detection element (13) designed to determine the initial position of said reference (4) when said textile item (3) is loaded onto said block (2), with respect to said pre-established operating position, and processing means operatively connected to said detection element (13) and designed to act upon said orientation means (9) so as to orient said textile item (3) and bring it in said pre-established operating position, in that said orientation means (9) comprise at least one roller (10) arranged parallel to said block (2), in that said orientation means (9) comprise at least one first pair (11) of rollers (9) arranged parallel to said block (2), in that said orientation means (9) further comprise at least one second pair (12) of rollers (10) arranged parallel to said block (2), said first pair (11) of rollers (10) being designed to associate with a front portion (5) of said textile item (3) and said second pair (12) of rollers (10) being designed to associated with a rear portion (6) of said textile item (3), in that said orientation means (9) further comprise at least one first handling element (17), controlled by said processing means, designed to transmit motion to said first pair (11) and/or second pair (12) of rollers (10), in that said textile item (3) further has a secondary reference, and in that said orientation means (9) further comprise a second handling element (18), said first handling element (17) being designed for act upon said first pair (11) of rollers (10) and said second handling element (18) being designed for act upon said second pair (12) of rollers (10) so as to orient said textile item (3) also with respect to said secondary reference.

2. The device (1) according to claim 1, characterized in that said orientation means (9) are designed to turn said textile item (3) with respect to said block (2).

3. The device (1) according to claim 1, characterized in that it comprises a plurality of detection elements (13) designed to get in contact with at least one portion of said textile item (3)

on said reference (4), so that at least one of said plurality of detection elements (13) detects said reference (4) in said initial position.

4. The device (1) according to claim 3, characterized in that said processing means are designed to receive signals from said detection elements (13) and to determine the extent of the clockwise or counter-clockwise rotation of the textile item (3) through said orientation means (9), so that it reaches said pre-established operation position depending on which detection element (13) detects said reference (4) when it lies in said initial position.

5. The device (1) according to claim 3, characterized in that said detection elements (13) are associated one beside the other and comprise sensing units (14) for detecting a portion having a higher textile density and/or a protruding portion of said textile item (3).

6. The device (1) according to claim 3, characterized in that each of said detection elements (13) further comprises a proximity sensor (15).

7. The device (1) according to claim 6, characterized in that each of said detection elements (13) further comprises at least one lever (16) associated with said proximity sensor (15) and designed to get in contact with said textile item (3) for transmitting to said sensor (15) the presence, if any, of said reference (4).

8. The device (1) according to claim 1, characterized in that said processing means comprise an electronic card.

9. The device (1) according to claim 1, characterized in that said first (17) and/or said second handling element (18) comprise a motor.

10. The device (1) according to claim 1, characterized in that said first (11) and/or said second pair (12) of rollers (10) can shift between an active position in which they are associated with said textile item (3), and a passive position in which they are removed and do not act upon said textile item (3).

11. The device (1) according to claim 1, characterized in that it further comprises means for stretching said textile item (3) in order to eliminate folds and creases and make said reference (4) more easily identifiable.

12. The device (1) according to claim 1, characterized in that at least one between said first (11) and said second pair (12) of rollers (10), in an active position, can shift vertically according to a direction basically parallel to a main axis of said rollers (10) along a lateral surface (7) of said textile item (3) so as to stretch it.

13. The device (1) according to claim 1, characterized in that it comprises at least two of said blocks (2), and in that said at least one detection element (13) and said orientation means (9), in a passive position, can shift transversally between a first operating position in which they act upon one of said blocks (2), and a second operating position in which they act upon the other one of said blocks (2).

14. The device (1) according to claim 3, characterized in that said plurality of detection elements (13) is designed to be associated with said textile item (3) on a portion thereof corresponding at least to one semi-circumference thereof, so that at least one of said detection elements (13) detects the initial position of said reference (4) and sends a corresponding signal to said processing means.

15. The device (1) according to claim 1, characterized in that said at least one block (2) comprises a block for ironing said textile items (3).

16. A machine for ironing textile items (3), characterized in that it comprises at least one automatic device (1) for orienting textile items (3) on blocks (2) in accordance with claim 1.

17. The machine according to claim 16, characterized in that it comprises a turntable that can be shifted between various stations, said at least one block (2) of said device (1) being associated with said turntable.

18. An automatic device (1) for orienting textile items (3) on blocks (2), comprising: at least one block (2) designed to receive a textile item (3) having at least one reference (4) with respect to which said textile item (3) should be oriented so as to reach a pre-established operating position with respect to said block (2), orientation means (9) designed to shift said textile item (3) on said block (2) so as to bring it in the pre-established operating position;

characterized in that it further comprises at least one detection element (13) designed to determine the initial position of said reference (4) when said textile item (3) is loaded onto said block (2), with respect to said pre-established operating position, and processing means operatively connected to said detection element (13) and designed to act upon said orientation means (9) so as to orient said textile item (3) and bring it in said pre-established operating position; in that said orientation means (9) comprise at least one roller (10) arranged parallel to said block (2), in that said orientation means (9) comprise at least one first pair (11) of rollers (9) arranged parallel to said block (2), in that said orientation means (9) further comprise at least one second pair (12) of rollers (10) arranged parallel to said block (2), said first pair (11) of rollers (10) being designed to associate with a front portion (5) of said textile item (3) and said second pair (12) of rollers (10) being designed to associated with a rear portion (6) of said textile item (3) and in that said first (11) and/or said second pair (12) of rollers (10) can shift between an active position in which they are associated with said textile item (3), and a passive position in which they are removed and do not act upon said textile item (3).

19. The device (1) according to claim 18, characterized in that it further comprises means for stretching said textile item (3) in order to eliminate folds and creases and make said reference (4) more easily identifiable.

20. An automatic device (1) for orienting textile items (3) on blocks (2), comprising:

at least one block (2) designed to receive a textile item (3) having at least one reference (4) with respect to which said textile item (3) should be oriented so as to reach a pre-established operating position with respect to said block (2), orientation means (9) designed to shift said textile item (3) on said block (2) so as to bring it in the pre-established operating position;

characterized in that it further comprises at least one detection element (13) designed to determine the initial position of said reference (4) when said textile item (3) is loaded onto said block (2), with respect to said pre-established operating position, and processing means operatively connected to said detection element (13) and designed to act upon said orientation means (9) so as to orient said textile item (3) and bring it in said pre-established operating position; in that said orientation means (9) comprise at least one roller (10) arranged parallel to said block (2), in that said orientation means (9) comprise at least one first pair (11) of rollers (9) arranged parallel to said block (2), in that said orientation means (9) further comprise at least one second pair (12) of rollers (10) arranged parallel to said block (2), said first pair (11) of rollers (10) being designed to associate with a front portion (5) of said textile item (3) and said second pair (12) of rollers (10) being designed to associated with a rear portion (6) of said textile item (3) and in that at least one between said first (11) and said second pair (12) of rollers (10), in an active position, can shift vertically according to a direction basically parallel to a main axis of said rollers (10) along a lateral surface (7) of said textile item (3) so as to stretch it.

21. The device (1) according to claim 20, characterized in that said first (11) and/or said second pair (12) of rollers (10) can shift between said active position in which they are associated with said textile item (3), and a passive position in which they are removed and do not act upon said textile item (3).

22. An automatic device (1) for orienting textile items (3) on blocks (2), comprising:

at least one block (2) designed to receive a textile item (3) having at least one reference (4) with respect to which said textile item (3) should be oriented so as to reach a pre-established operating position with respect to said block (2), orientation means (9) designed to shift said textile item (3) on said block (2) so as to bring it in the pre-established operating position;

characterized in that it further comprises at least one detection element (13) designed to determine the initial position of said reference (4) when said textile item (3) is loaded onto said block (2), with respect to said pre-established operating position, and processing means operatively connected to said detection element (13) and designed to act upon said orientation means (9) so as to orient said textile item (3) and bring it in said pre-established operating position; in that it comprises at least two of said blocks (2), and in that said at least one detection element (13) and said orientation means (9), in a passive position, can shift transversally between a first operating position in which they act upon one of said blocks (2), and a second operating position in which they act upon the other one of said blocks (2).

23. The device (1) according to claim 22, characterized in that said first (11) and/or said second pair (12) of rollers (10) can shift between an active position in which they are associated with said textile item (3), and said passive position in which they are removed and do not act upon said textile item (3).

24. A method for orienting textile items (3) on blocks (2) comprising the following steps:

loading a textile item (3), having a reference (4) with respect to which it should be oriented to reach a pre-established operating position, onto a block (2), detecting the initial position of said reference (4) of said textile item (3);

characterized in that it further comprises the following steps:

determining the necessary shift so as to bring said reference (4) from said initial position to said pre-established operating position and handling said textile item (3) with respect to said block (2) according to said determined shift so as to reach said pre-established operating position, the method further comprising a second step of detecting the initial position of a secondary reference associated with said textile item (3), a second step of determining the necessary shift so as to bring said secondary reference in a respective pre-established operating position, and a second step of handling said textile item (3) on said block (2) so that said secondary reference reaches said respective pre-established operating position, said second detecting step, said second determining step and said second handling step following said handling step.

25. The method according to claim 24, characterized in that said handling step is performed by turning said textile item (3) on said block (2).

26. The method according to claim 24, characterized in that said detecting step is performed by testing mechanically the presence of said reference (4) on said textile item (3), said reference (4) comprising a protruding portion.

27. The method according to claim 24, characterized in that it further comprises a step of stretching said textile item (3), which is performed at least before or during the detecting step so as to eliminate folds and creases from said textile item (3) and to make said reference (4) more identifiable.

28. The method according to claim 27, characterized in that said stretching step is performed during the handling step.

29. The method according to claim 24, characterized in that said reference (4) comprises a portion having a higher textile density than the average density of said textile item (3).

30. The method according to claim 24, characterized in that said reference (4) comprises a protruding portion with respect to said textile item (3).

31. The method according to claim 24, characterized in that said textile item (3) comprises a stocking or a sock.

32. The method according to claim 31, characterized in that said reference (4) comprises a toe-closing seam of said textile item (3).

* * * * *